US007056160B2

(12) United States Patent
Correll et al.

(10) Patent No.: US 7,056,160 B2
(45) Date of Patent: Jun. 6, 2006

(54) TERMINAL LOCKING MECHANISM FOR HYBRID ELECTRICAL CONNECTOR

(75) Inventors: Michael A Correll, Hershey, PA (US); Daniel R Ringler, Elizabethville, PA (US); Troy E Conner, York, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/020,439

(22) Filed: Dec. 22, 2004

(65) Prior Publication Data

US 2005/0106951 A1 May 19, 2005

Related U.S. Application Data

(63) Continuation-in-part of application No. 10/460,884, filed on Jun. 13, 2003, now Pat. No. 6,881,102.

(51) Int. Cl.
*H01R 13/514* (2006.01)

(52) U.S. Cl. ..... 439/752.5; 439/752

(58) Field of Classification Search ..... 439/752.5, 439/682, 752

See application file for complete search history.

(56) References Cited

U.S. PATENT DOCUMENTS 4,124,264 A * 11/1978 Kato et al. ..... 439/595
4,750,893 A 6/1988 Sueyoshi
5,190,477 A * 3/1993 Akeda ..... 439/595
5,626,499 A * 5/1997 Yagi et al. ..... 439/752.5
5,749,753 A * 5/1998 Chishima et al. ..... 439/752.5
5,785,557 A 7/1998 Davis
5,984,737 A * 11/1999 Nagano et al. ..... 439/752
5,989,066 A 11/1999 Cox ..... 439/595
6,033,267 A * 3/2000 Smyk ..... 439/682
6,190,195 B1 * 2/2001 Yamamoto et al. ..... 439/381
6,375,501 B1 * 4/2002 Kojima ..... 439/595
6,390,860 B1 * 5/2002 Shirouzu et al. ..... 439/752.5
6,435,919 B1 * 8/2002 Saka et al. ..... 439/752

FOREIGN PATENT DOCUMENTS

EP 0 951 102 10/1999

* cited by examiner

*Primary Examiner*—Gary F. Paumen

(57) ABSTRACT

A hybrid electrical connector includes both signal and power contacts in the same connector housing. The housing includes a plurality of axially extending passageways for receipt of the signal contacts and a plurality of axially extending cavities for receipt of the power contacts. The connector housing further includes a plurality of transversely extending slots extending through the connector housing intersecting with individual power contact cavities. Moreover, the housing includes a protrusion extending across the lower surface thereof. A Y-shaped terminal retaining member is insertable in the slots and is resiliently held in place in the slots. The power terminals include an opening therethrough forming a locking shoulder for receipt of the transversely extending locking member. In addition, the power terminals include notches for mating with the protrusion. The combination of the notches and the protrusion ensure the terminal is properly positioned within the housing.

14 Claims, 8 Drawing Sheets

TERMINAL LOCKING MECHANISM FOR HYBRID ELECTRICAL CONNECTOR

This Application is a Continuation-In-Part of U.S. application Ser. No. 10/460,884 filed on Jun. 13, 2003 now U.S. Pat. No. 6,881,102, which is incorporated by reference as if fully rewritten herein.

The subject invention relates to an improved electrical connector housing and more particularly to an improved secondary retention feature for the retention of electrical terminals within their housing.

BACKGROUND OF THE INVENTION

It is quite common in the electrical connector industry today to require that electrical terminals have redundant retention means within their connector housings. The first or primary means of retaining the electrical terminals within the housing is to have a stamped-out lance from the electrical terminal metal body, which abuts a shoulder within the housing. The redundant or secondary retention means is typically profiled as a plastic movable member, which can be moved into place over the terminal to lock the terminal in place. Some of these members are moved transversely of the axial direction, while some are defined as hinged flaps, which are rotated into place. These flaps include plastic tabs which, when rotated, reside in a groove or gap within the terminal to retain the contact in place.

In one prior method, as shown for example in U.S. Pat. No. 4,750,893, an electrical connector housing has a hinged flap which rotates into place. The electrical connector has an insulating housing and a plurality of electrical terminals disposed in terminal receiving passageways within the housing. The housing includes an upper retention flap including a retention tab which, when in its locked location, is positioned adjacent to an edge of the terminal to retain the terminal in the passageway. The flap has tabs which reside at an edge of the contact to prevent withdrawal thereof. If more than one row of contacts is present, then two hinged flaps on the outside of each of the two rows are used to retain the terminals in place.

It is also well known in the industry to provide a hybrid electrical connection system, comprised of both signal and power contacts. See, for example, U.S. Pat. No. 5,785,557 and EP Patent Application 0951102. In particular with hybrid connectors, given the complexity and cost, it is desirable to be able to remove and/or replace contacts within the connector without destroying or damaging the electrical connector or any of the connections thereto.

The objects of the invention are therefore to improve upon these known connection systems.

SUMMARY OF THE INVENTION

The objects of the invention have been accomplished by providing an electrical connector comprising an insulative housing comprising a front portion and a rear portion, the housing having at least one contact receiving cavity extending therethrough. An electrical terminal is located within the cavity, the terminal having a front contact portion, wherein the front contact portion is configured to mate with the front portion in a manner ensuring the electrical terminal is properly located within the insulative housing.

The front portion of the housing may include a pair of parallel side walls, a top portion and a bottom portion, where the bottom portion includes a mating portion configured to mate with the front contact portion of the electrical terminal.

The front contact portion of the electrical terminal includes a pair of parallel contact plates, the contact plates including a mating portion sized and configured to mate with the bottom portion of the housing.

The mating portion of the housing is a protrusion and the mating portion of the contact plates is a notch. The upper portion of the housing includes a slot arranged perpendicular to the contact receiving cavity, and the electrical terminal includes a mating slot, wherein the slot in the upper portion and the mating slot of the electrical terminal are aligned when the mating portions are in engagement.

The electrical connector further includes a terminal locking member having resilient fork members comprising a plurality of locking members, the resilient fork members being resiliently biasable into a locked position within the slots. The terminal locking member is Y-shaped.

The distance separating the front edge of the housing and the front edge of the electrical terminal can vary. In one embodiment this distance is about 0.035 inches when the mating portions are in mating engagement. In another embodiment, the distance separating the front edge of the housing and the front edge of the electrical terminal is about 0.073 inches when the mating portions are in mating engagement.

In another embodiment of the invention, an electrical connector comprises an insulative housing comprising a front portion and a rear portion, the housing having at least one contact receiving cavity extending therethrough. An electrical terminal is located within the cavity, where the terminal has a front contact portion. A terminal locking member locks the electrical terminal to the insulative housing. A means is provided for ensuring the electrical terminal is positioned properly within the insulative housing prior to the insertion of the terminal locking member.

The front portion of the housing includes a protrusion sized and configured to mate with a notch in the front contact portion of the electrical terminal, and the mating between the protrusion and the notch forms the positioning means. The housing includes a slot positioned transversely to the cavity and the electrical terminal includes a slot sized and configured to receive the terminal locking member. The slots come into alignment as the positioning means ensures the electrical terminal is properly located in the insulative housing. The terminal locking member includes resilient fork members having locking members and being resiliently biasable into a locking position within the slot of the housing, with a portion of the terminal locking members engaging a portion of the electrical terminal.

In yet another embodiment of the invention, an electrical connector comprises an insulative housing including a back portion and a front portion having an upper wall, a lower wall and a pair of the walls defining a front edge in a plane; the insulative housing further including a cavity extending therethrough and a slot arranged transverse to the cavity. An electrical terminal is located within the cavity, the terminal having a crimp portion and a front contact portion comprising a pair of parallel side walls and an intermediate member extending therebetween, the electrical terminal further including a slot intermediate the front contact portion and the crimp portion. A terminal locking member has resilient fork members being resiliently biasable into a locked position within the slots, the fork members having locking members affixing the terminal locking member to the housing and the electrical terminal. The insulative housing further includes a protrusion in the lower wall and the electrical terminal further includes a notch in each of the parallel side walls, the notches being sized and configured to receive the protrusion thereby ensuring the electrical terminal is properly positioned within the insulative housing.

The slots align as the notches receive the protrusion. The parallel side walls and the intermediate portion of the electrical terminal define a front edge located in a plane, the plane of the electrical terminal being spaced apart from the front edge of the insulative housing. The spacing distance can vary; in one case it is equal to about 0.073 inches and in another case the distance is equal to about 0.035 inches. The terminal locking member may be Y-shaped.

The slot of the electrical terminal is located in the intermediate portion connecting the pair of parallel side walls. The terminal locking member further includes a leg portion extending through the slot of the electrical terminal. The pair of parallel side walls of the housing are positioned adjacent the pair of parallel side walls of the electrical terminal and the upper wall of the housing is positioned adjacent the intermediate portion of the electrical terminal.

The housing prevents the full insertion of the wrong type of terminal into the housing. Thus, this modification prevents improper assembly of the connector. Moreover, the modified housing is configured to prevent reception of a terminal locking member when an improper terminal has been inserted into the housing.

The front portion of the modified housing includes an integral protrusion formed in the lower surface. In addition, the front portion of the modified terminal includes a pair of parallel contact plates each including a notch to receive the protrusion. The engagement between the notches and the protrusion ensures the terminal is properly positioned within the housing.

DETAILED DESCRIPTION OF THE PREFERRED EMBODIMENT

Figure 1:
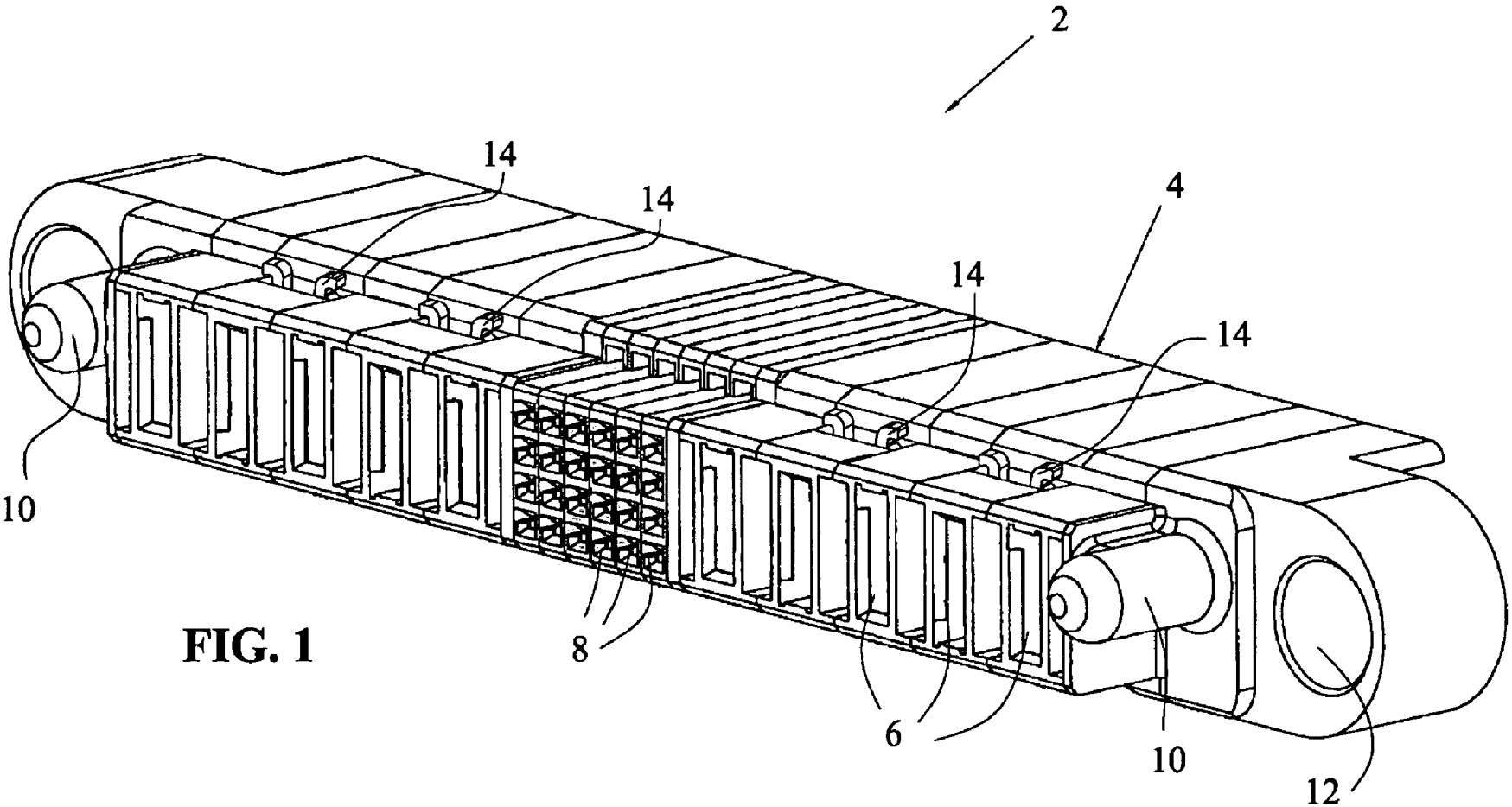
FIG. 1 is a perspective view showing the hybrid electrical connector of the present invention.
Figure 2:
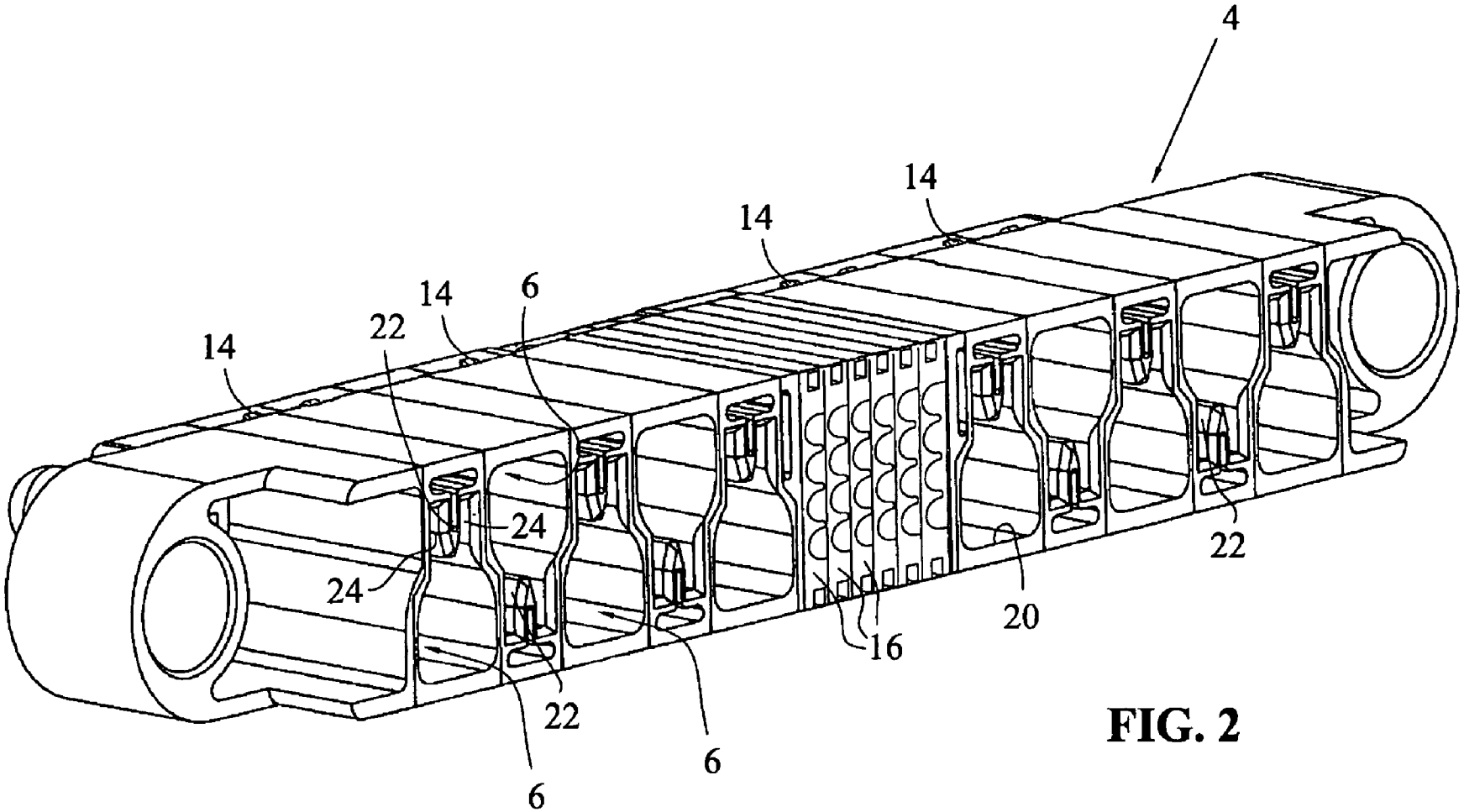
FIG. 2 is a rear perspective view of the connector of FIG. 1.

With reference first to FIG. 1, a connector is shown at 2 as a hybrid electrical connector, having a housing 4 with a plurality of contact cavities 6 for receipt of power contacts, and a plurality of contact receiving cavities 8 for receipt of signal contacts. The housing 4 further includes polarizing lugs at 10 and mounting apertures at 12. With reference still to FIG. 1, the power terminal receiving cavities include terminal locking members 14 snapped in place to retain the terminals in the individual passageways 6, as will be described further herein. As shown in FIG. 2, a rear perspective view of the connector housing 4 is shown, where the power terminal receiving cavities 6 are shown in greater detail, as will be described herein. Finally, the connector housing 4 includes a plurality of locking inserts 16 to lock the signal contacts in place, which are further described in U.S. patent application Ser. No. 10/460,900 incorporated herein by reference.

Figure 3:
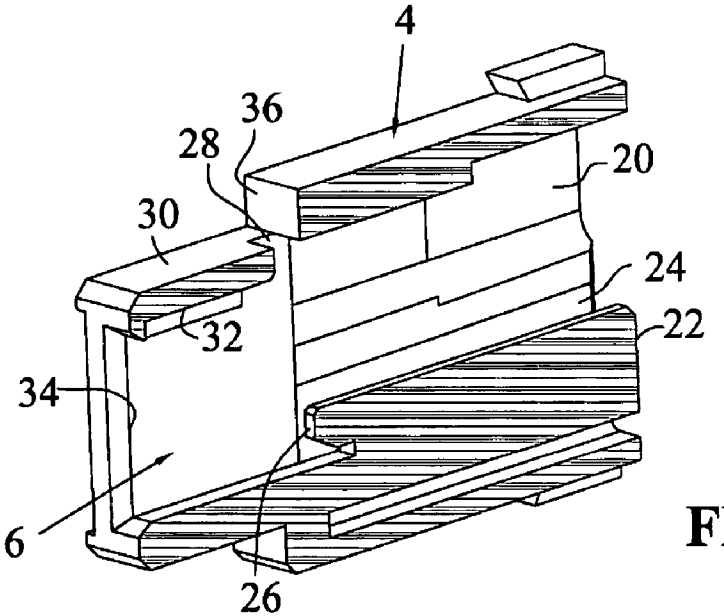
FIG. 3 is a fragmentary cross-sectional view through the cavity for the power terminal of the present invention.
Figure 6:
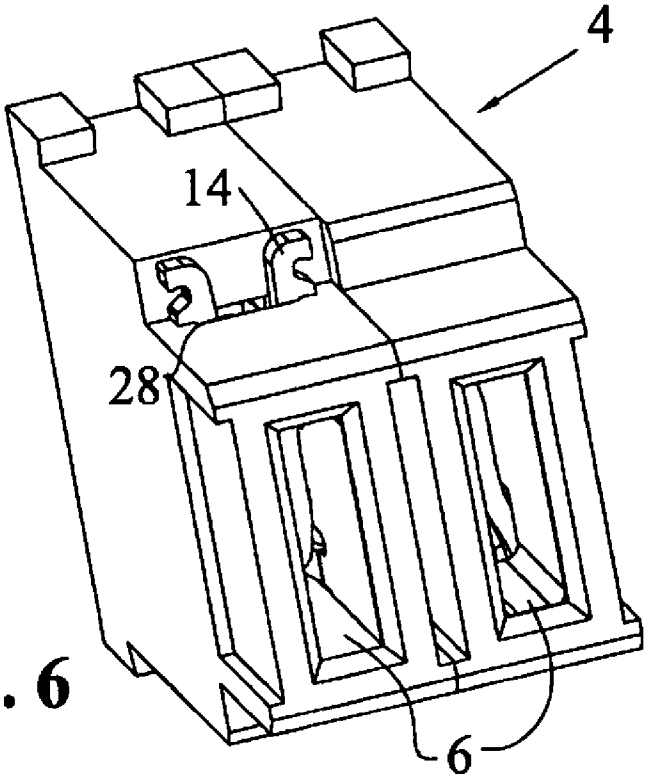
FIG. 6 is a view similar to that of FIG. 3, showing the terminal locking member in full position.

With reference to FIGS. 2 and 3, the detail of the power cavities 6 will be described in greater detail. As shown in FIG. 2, each of the cavities 6 include an enlarged opening portion 20 having rib portions 22 positioned opposite the enlarged portions 20. The rib portion is positioned centrally so as to define two slot portions at 24, which flank the rib 22. As shown best in FIG. 3, the central rib 22 terminates in a forwardly facing shoulder at 26, as will be described herein. As also shown best in FIG. 3, the housing 4 includes a slot at 28, which extends transversely of the longitudinal axis of the cavity 6 and intersects with the cavity to communicate therewith. It should be noted that a rear surface 36 defining the cavity 28 is proximate to the forwardly facing shoulder 26. Slot 28 extends through top surface 30 of housing 4 and through inner surface 32 of housing 4.

Figure 4:
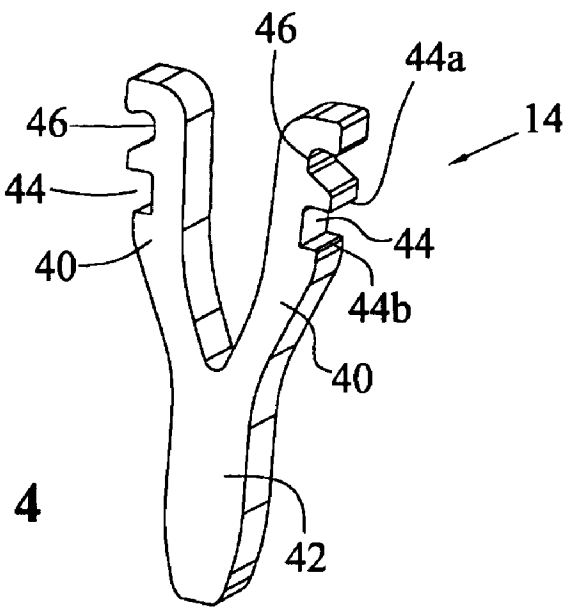
FIG. 4 is a perspective view of the terminal locking mechanism shown in FIGS. 3 and 4.

With respect now to FIG. 4, terminal locking member 14 is shown in greater detail. Terminal locking member 14 is Y-shaped in configuration, including two resilient fork members 40 and a lower leg portion 42. Each of the fork members 40 are resiliently biasable inwardly and include locking members at 44. The locking members 44 are defined by upper and lower surfaces 44*a* and 44*b*, which are spaced apart slightly greater than the distance between surfaces 30 and 32 of the housing member 4 (FIG. 3). The terminal locking member 14 further includes gripping area 46 for removal of the terminal locking member 14, as described herein.

Figure 8:
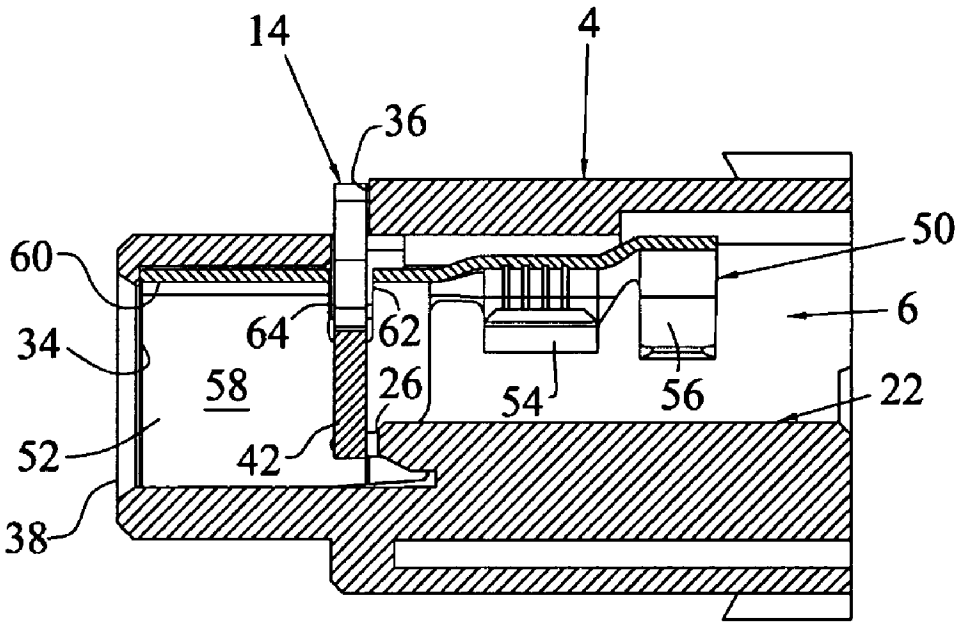
FIG. 8 is a cross-sectional view through lines 8—8 of FIG. 7.

With respect now to FIG. 8, an electrical terminal 50 is shown as a power terminal, generally comprised of a front contact portion 52, a crimp barrel 54, and a strain relief member at 56. The front contact portion 52 is generally comprised of a contact having a U-shaped cross-section, generally comprised of side-by-side parallel contact plates 58 (only one of which is shown in FIG. 8) connected together by way of a bight portion 60. As shown in FIG. 8, the terminal 50 also includes an opening 62, which extends through the bight portion 60 and partially into the side-by-side contact plates 58, thereby defining a retaining and locking shoulder 64 on the terminal 50. With the above elements as described, the assembly and application of the connector will now be described in detail.

With respect first to FIGS. 2 and 8, it should be appreciated that the conductors for the power are terminated to contacts in a conventional manner, that is, by stripping the end of the insulation, then placing the bared conductors in the crimp barrel portion 54 of the terminals and crimping the conductors to the crimp barrel, at the same time applying the strain relief 56 around the insulation of the wire. As shown in FIG. 2, the connector is designed to accommodate 10 power conductors, and therefore 10 such terminals would be prepared. It is also evident from FIG. 2 that some of the cavities 6 for receiving the power terminals are inverted relative to each other, and that the enlarged opening portion 20 is to receive the crimp barrel strain relief and conductor therein.

Figure 5:
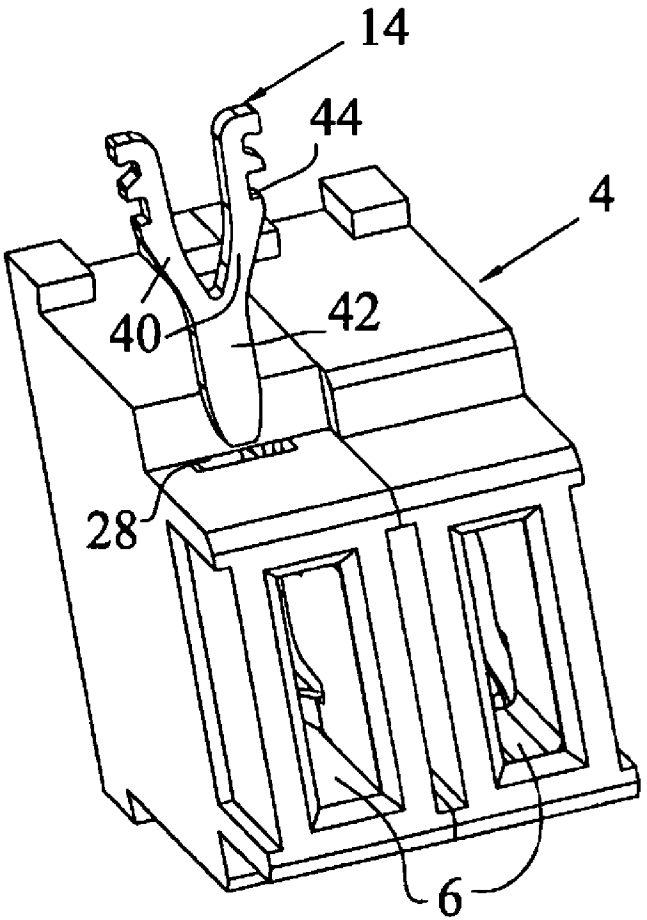
FIG. 5 is a fragmentary perspective view showing the terminal locking member of the power terminal cavities poised for receipt in its perspective slot.

Therefore, the terminals 50, when prepared, are inserted such that the side-by-side contact plates are positioned in the slots 24, with the contact plates flanking the rib 22 and are slidably received therein, with the bight portion 60 positioned on a lower surface of the enlarged opening 20. Thus, when the terminals 50 are fully positioned in their cavities 6, a front edge of the contact plates 58 abut the corresponding shoulder 34 of housing 4 to locate the terminals therein. When in this position, and as shown in FIG. 5, the retaining members 14 can be received transversely into the slot 28, which then causes leg 42 to communicate within the cavity 6 and lock terminals 50 in place, as to be described.

Figure 7:
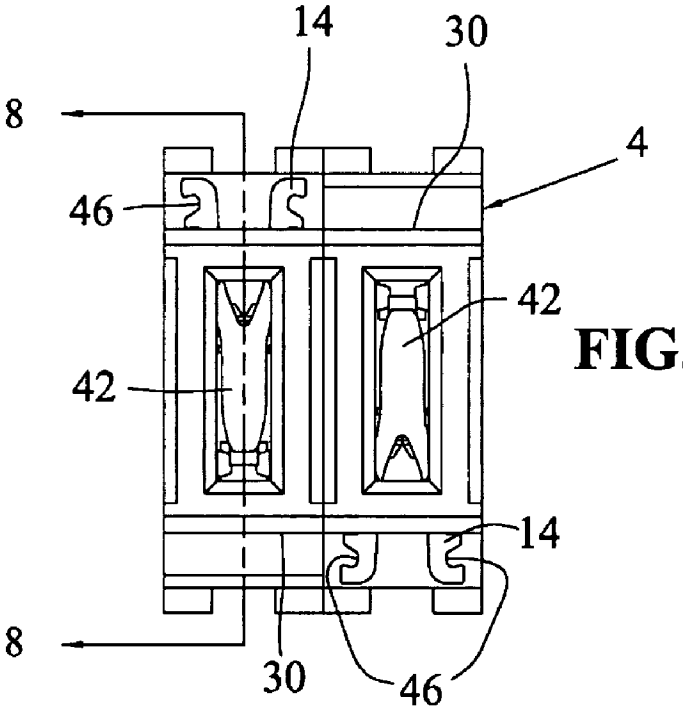
FIG. 7 is a front plan view of two of the power terminal cavities.

It should also be appreciated from FIGS. 7 and 8 that, when terminal 50 is fully positioned as described above, and as retaining member 14 is fully positioned as shown in FIG. 8, the yoke members 40 of retaining member 14 project into the portion of opening 62, which extends into the opposed contact plates 58, while the leg portion 42 extends between the side-by-side contact plates and is positioned adjacent to the forwardly facing surface 26 of rib 22. Thus, as shown in FIG. 8, the power terminals are fixedly held in place in their corresponding cavities 6 by the retaining members 14.

For example, if a strain is placed on the conductors towards the right as viewed in FIG. 8, the locking surface 64 of opening 62 would cause an abutment against the retaining member 14. Retaining member 14 is held fixed against surface 36, and even leg portion 42 is backed up by forwardly facing surface 26 of rib member 22.

It should also be appreciated from FIG. 7 that the retaining members 14 extend in alternate directions, such that one retaining member extends with the leg portion 42 extending downwardly, whereas an adjacent or alternate cavity has a retaining member 14, with the leg portion 42 extending upwardly. This is consistent with the alternate staggering of the contact cavity 6 as shown in FIG. 2. It should also be appreciated from FIG. 7 that the portions 46 of the retaining members 14 are exterior to surface 30, such that a common gripping tool, such as standard hook-nose tweezers, can be used for extracting the retaining members 14.

Figure 10:
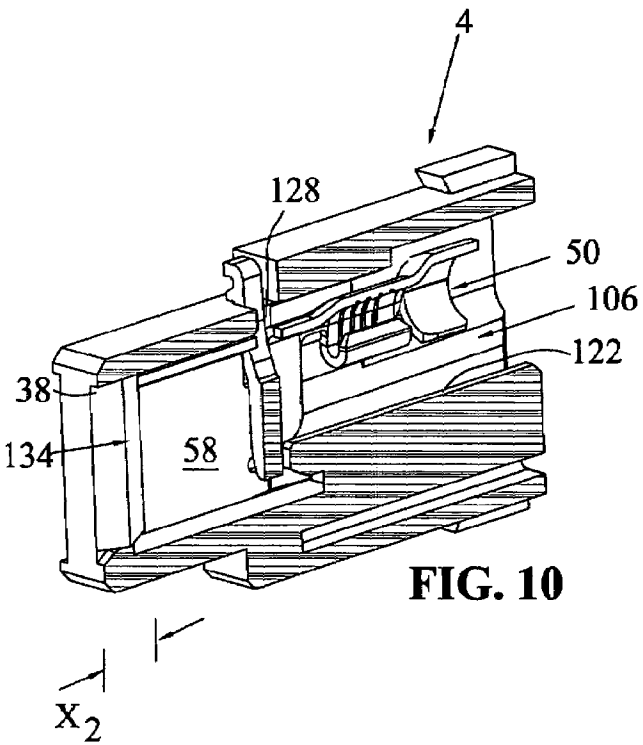
FIG. 10 is a perspective view similar to that of FIG. 9, showing the power terminal staggered further rearwardly.
Figure 9:
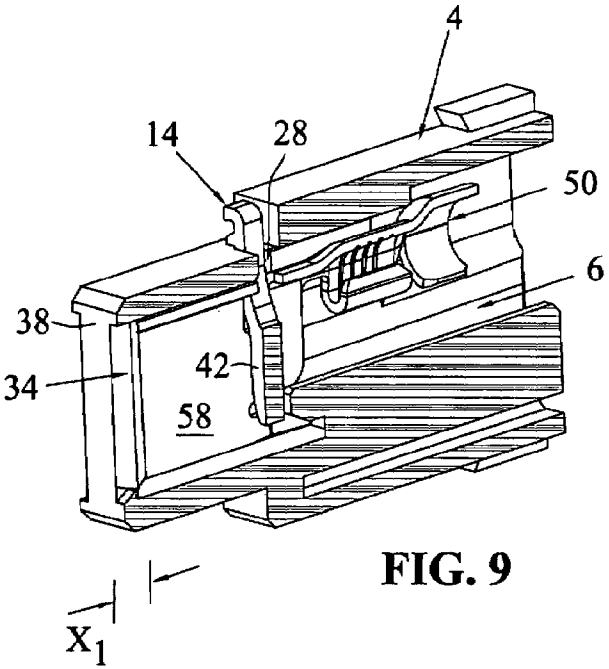
FIG. 9 is a cut-away perspective view through the power contact and associated cavity, similar to that shown in FIG. 8.

With reference now to FIGS. 9 and 10, it should be appreciated that various cavities are staggered, from the front face 38 to a front edge of the contact plate 58. For example, as shown in FIG. 9, the front edge of the contact plate 58 is positioned a distance $X_1$ from the front faced 38 of the housing 4. With respect now to FIG. 10, other power cavities can be configured as shown at 106, with a shoulder such as 134 positioned further inwardly than shoulder 34, such that the front edge of contact plate 58 is positioned a distance $X_2$ from the front edge 38 of housing 4, to perform a last-mate, first-break sequencing of the power terminals. Contacts 50 are modified slightly in the length of the contact plate 58 to accommodate this difference.

In the preferred embodiment, the dimensions $X_1$ and $x_2$ are on the order of 0.035 inches and 0.073 inches, respectively.

Figure 11:
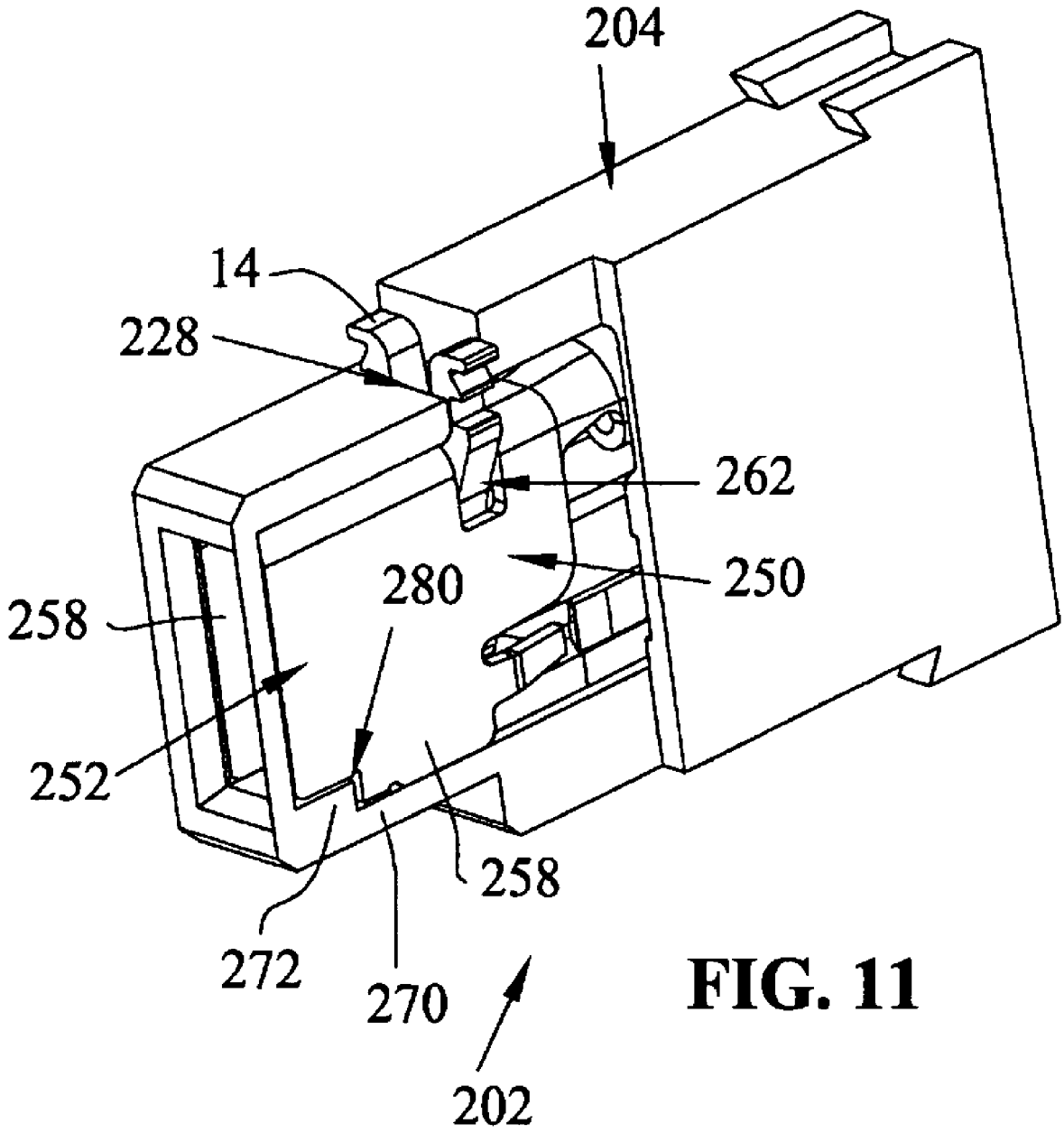
FIG. 11 is a perspective view of a second embodiment of a power terminal with a side wall removed for illustrative purposes.

FIG. 11 depicts an alternative embodiment of a mate-first, break-last (MFBL) connector generally indicated by numeral 202. With respect to the description of MFBL connector 202, only the differences distinguishing MFBL connector 202 from the previous MFBL connector 2 (FIG. 10) will be discussed. In FIG. 11, connector 202 has been illustrated with the side wall of housing 204 removed in order to better illustrate the internal configuration of connector 202.

Connector 202 includes a modified housing 204 and modified terminal 250. Modified housing 204 includes a lower surface 270 with an integral protrusion 272 formed therein. In the present embodiment, integral protrusion 272 extends upward from lower surface 270. Protrusion 272 extends across housing 204 from the internal surface of one wall to the internal surface of the opposing wall.

With reference still to FIG. 11, modified terminal 250 includes a modified front contact portion 252 comprising a pair of modified parallel contact plates 258. Terminal 250 is similar to terminal 50 described in detail above and depicted in FIG. 8, with the exception that plates 252 each include a notch 280. In the present embodiment, notch 280 is positioned in the front, lower corner of parallel contact plates 258.

In the present embodiment of the invention, the notches 280 are sized and configured to receive the integral protrusions 272 formed in the lower surface 270 of housing 204. The engagement between protrusion 272 and notches 280 ensures modified terminal 252 is located properly within housing 204 after insertion. With protrusion 272 received within notch 280, slot 228 of modified housing 204 should be in alignment with opening 262 of terminal 250. Accordingly, terminal locking member 14 may be inserted into both slot 228 and opening 262 in the manner described above thereby locking terminal 250 within housing 204.

Figure 12:
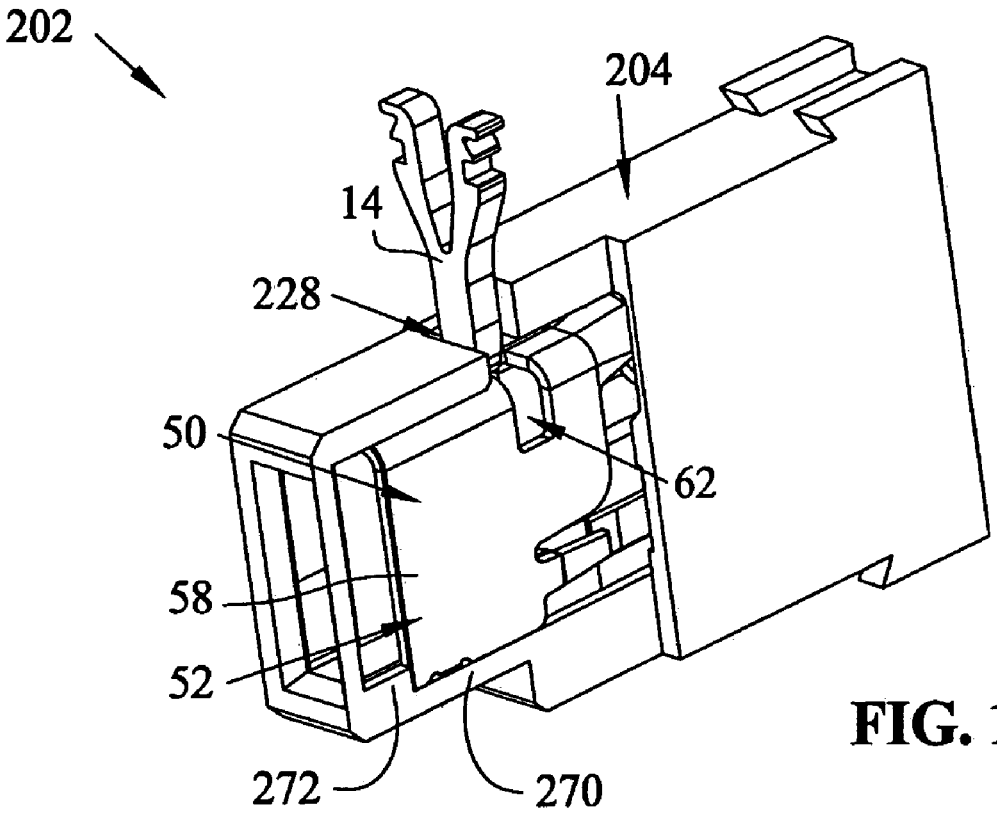
FIG. 12 is a perspective view of an incorrectly assembled power terminal with a side wall removed for illustrative purposes.
Figure 13:
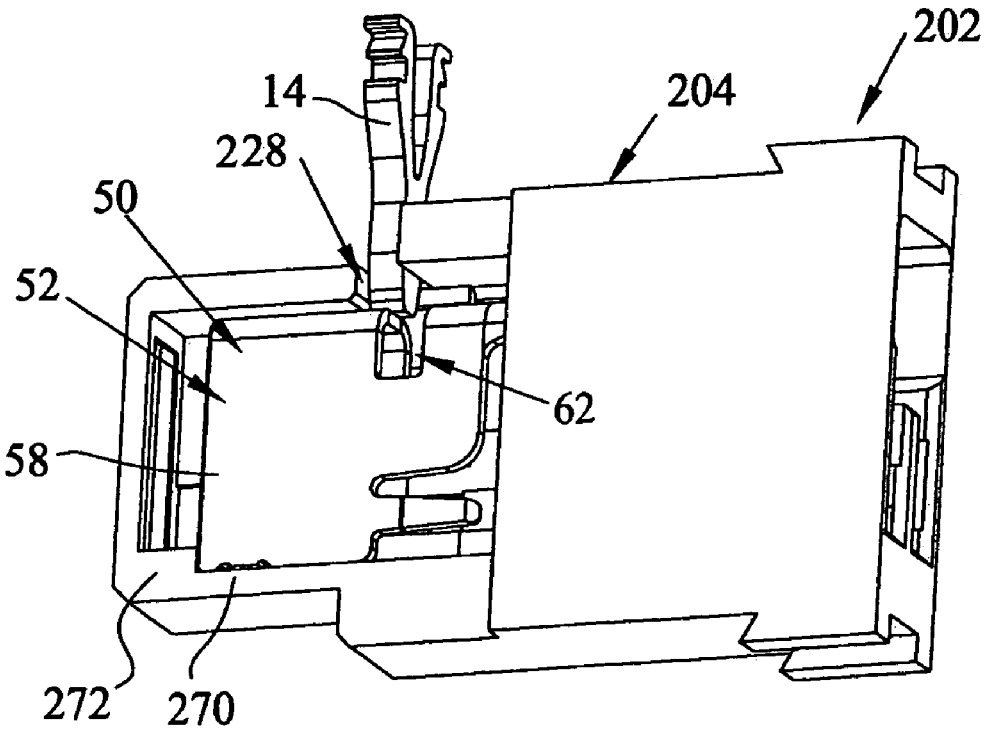
FIG. 13 is a rear perspective view of the power terminal depicted in FIG. 12.

FIGS. 12 and 13 depict an incorrectly assembled connector generally indicated by numeral 202. Connector 202 includes a standard terminal 50, of the type described above and depicted in FIG. 8, inserted into MFBL modified housing 204.

It should be noted that the contact plates 58 of standard terminal 50 do not include notches such as those present within modified contact plate 258 (See FIG. 11). As seen specifically in FIG. 13, the lack of notches in contact plate 58 prevents terminal 50 from being fully inserted into modified housing 204, that is, into the wrong housing. Accordingly, slot 228 does not align with opening 62 of terminal 50. The misalignment between opening 62 and slot 228 prevents terminal locking members 14 from being inserted into housing 204.

It should be apparent that the inclusion of protrusion 272 in modified housing 204 and notches 280 in the corresponding terminal 250 ensures proper alignment between these components in the final assembly. Moreover, protrusion 270 prevents insertion of a standard terminal 50 during assembly. Accordingly, the modified housing 204 and terminal 250 reduces mistakes in assembling a MFBL connector by preventing usage of a standard terminal with a MFBL housing.

The invention claimed is:

1. An electrical connector comprising:

an insulative housing comprising a front portion and a rear portion, said housing having at least one contact receiving cavity extending therethrough, said front portion of said housing including a pair of parallel side walls, a top portion and a bottom portion, said bottom portion having a protrusion; and an electrical terminal located within said cavity, said terminal having a front contact portion including a pair of parallel contact plates, each of said contact plates having a mating portion and a notch in said mating portion;

wherein said protrusion is received in said notches and is engaged by said mating portions of said contact plates when said terminal is installed in said cavity, thereby ensuring that said terminal is properly located within said housing.

2. The electrical connector as set forth in claim 1, wherein said top portion of said housing includes a slot arranged perpendicular to said contact receiving cavity, and said electrical terminal includes a mating slot, wherein said slot in said top portion and said mating slot of said electrical terminal are aligned when said mating portions of said contact plates are in engagement with said protrusion.

3. The electrical connector as set forth in claim 2, further including a terminal locking member having resilient fork members comprising a plurality of locking members, said resilient fork members being resiliently biasable into a locked position within said slots.

4. The electrical connector as set forth in claim 3, wherein said terminal locking member is Y-shaped.

5. An electrical connector comprising:

an insulative housing comprising a front portion and a rear portion, said front portion of said housing including a protrusion, said housing having at least one contact receiving cavity extending therethrough, said housing including a slot positioned transversely to said cavity;

an electrical terminal located within said cavity, said terminal having a front contact portion and a notch in said front contact portion, said terminal including a slot that aligns with said slot in said housing when said terminal is correctly positioned in said cavity;

a terminal locking member received in said slots, said terminal locking member having resilient fork members that are resiliently biased into a locking position within said slots for locking said electrical terminal to said insulative housing; and wherein said protrusion is received in said notch for ensuring that said electrical terminal is positioned properly within said insulative housing prior to the insertion of said terminal locking member.

6. An electrical connector comprising:

an insulative housing including a back portion and a front portion having an upper wall, a lower wall and a pair of side walls defining a front edge in a plane; said insulative housing further including a cavity extending therethrough and a slot arranged transverse to said cavity;

an electrical terminal located within said cavity, said terminal having a crimp portion and a front contact portion comprising a pair of parallel side walls and an intermediate member extending therebetween, said electrical terminal further including a slot intermediate said front contact portion and said crimp portion; and a terminal locking member having resilient fork members being resiliently biasable into a locked position within said slots, said fork members having locking members affixing said terminal locking member to said housing and said electrical terminal;

wherein said insulative housing further includes a protrusion in said lower wall and said electrical terminal further includes a notch in each of said parallel side walls, said notches being sized and configured to receive said protrusion thereby ensuring that said electrical terminal is properly positioned within said insulative housing.

7. The electrical connector as set forth in claim 6, wherein said slots align as said notches receive said protrusion.

8. The electrical connector as set forth in claim 7, wherein said parallel side walls and said intermediate portion of said electrical terminal define a front edge located in a plane, said plane of said electrical terminal being spaced at a distance from said front edge of said insulative housing.

9. The electrical connector as set forth in claim 8, wherein said distance is equal to about 0.073 inches.

10. The electrical connector as set forth in claim 8, wherein said distance is equal to about 0.035 inches.

11. The electrical connector as set forth in claim 6, wherein said terminal locking member is Y-shaped.

12. The electrical connector as set forth in claim 6, wherein said slot of said electrical terminal is located in the intermediate portion connecting said pair of parallel side walls.

13. The electrical connector as set forth in claim 6, wherein said terminal locking member further includes a leg portion extending through said slot of said electrical terminal.

14. The electrical connector as set forth in claim 6, wherein said pair of parallel side walls of said housing are positioned adjacent said pair of parallel side walls of said electrical terminal and said upper wall of said housing is positioned adjacent said intermediate portion of said electrical terminal.

* * * * *